United States Patent [19]

Romer et al.

[11] 4,289,073

[45] Sep. 15, 1981

[54] WARHEAD WITH A PLURALITY OF SLAVE MISSILES

[75] Inventors: Rudolf Romer, Kaarst; Hendrik R. Lips, Duesseldorf; Benjamin Furch, Unterluess; Hans Orth, Ratingen, all of Fed. Rep. of Germany

[73] Assignee: Rheinmetall GmbH, Duesseldorf, Fed. Rep. of Germany

[21] Appl. No.: 67,143

[22] Filed: Aug. 16, 1979

[30] Foreign Application Priority Data

Aug. 16, 1978 [DE] Fed. Rep. of Germany ..... 2835817

[51] Int. Cl.[3] ..... F42B 13/02

[52] U.S. Cl. ..... 102/476

[58] Field of Search ..... 102/24 HC, 56 SC

[56] References Cited

U.S. PATENT DOCUMENTS

| | | | |
|---|---|---|---|
| 2,892,407 | 6/1959 | MacLeod | 102/56 SC X |
| 3,949,674 | 4/1976 | Talley | 102/56 SC X |
| 4,030,418 | 6/1977 | Regber et al. | 102/24 HC X |
| 4,040,354 | 8/1977 | Stern | 102/56 SC X |
| 4,201,135 | 5/1980 | Nikowitsch | 102/24 HC X |

FOREIGN PATENT DOCUMENTS

| | | | |
|---|---|---|---|
| 1453815 | 2/1969 | Fed. Rep. of Germany | 102/24 HC |
| 2519507 | 11/1976 | Fed. Rep. of Germany | 102/56 SC |

*Primary Examiner*—Peter A. Nelson

[57] ABSTRACT

A disc-shaped warhead adapted for being fired from a barrel weapon, and particularly for being stacked with a plurality of similar warheads in a load-carrying missile for ejection one after the other. The warhead has a plurality of slave missiles disposed in radially directed firing tubes, and a parachute connected to the warhead and causing a directional, braked descent in the target area. Each of the slave missiles has a proximity fuse to detonate it individually after reaching a predetermined distance from the ground or other target.

7 Claims, 3 Drawing Figures

WARHEAD WITH A PLURALITY OF SLAVE MISSILES

This application is related to the coassigned application (R684) of Romer, Lips, and Orth filed contemporaneously herewith.

The invention relates to a warhead adapted for being fired from a barrel weapon, and particularly for being stacked with a plurality of similar warheads in a load-carrying missile for ejection one after the other. The warhead has a plurality of slave missiles disposed in radially directed firing tubes, a parachute connected to the warhead and causing a directional, braked descent in the target area, each of the slave missiles having a proximity fuse which causes its individual firing after its ejection from the warhead.

A warhead of the same general type is disclosed in German Pat. DE-OS No. 2 004 637. In such disclosed warhead, firing tubes are pivotally connected to a central connecting element, the firing tubes in their retracted state being disposed in a missile casing, and after leaving the missile casing they automatically assume an extended position under the action of their inertia. A braking parachute is connected to one or more of such warheads, while a stabilizing weight with a proximity fuse, disposed at the tip, causing the detonation of the warhead and the firing of the firing tubes at a certain distance from the ground.

Such known warhead is conveyed with other similar warheads disposed axially one behind the other into a target area by means of bombs, missiles, or rockets so as to cause an increased destructive action upon the target.

The above-described known warhead is not suitable for being fired from barrel weapons because its manner of construction does not permit it to withstand high firing accelerations. Furthermore, the arrangement of the individual elements of the warhead takes up a great deal of space so that only a comparatively small number of such warheads can be conveyed in a rocket or a bomb. Finally, the opening and locking mechanism for the firing tubes is complicated and expensive to produce.

It is among the objects of the present invention, while avoiding the disadvantages of the above-described known warhead, to provide a warhead of simple construction which has as large a number as possible of highly effective slave missiles, which is suitable for firing from a barrel weapon, and which is of such configuration that a large number of warheads can be stowed in a load-carrying missile.

The warhead of the invention has a body, a plurality of slave missiles containing explosive material disposed in firing tubes mounted in the body and directed radially thereof, a parachute connected to the warhead and causing a directional, braked descent thereof in the target area, and a proximity fuse on the warhead which causes the ejection of the slave missiles from the firing tubes. The warhead is of disc-shaped construction, the body of the warhead comprising a housing having a cover plate at each end thereof, each cover plate having an outwardly open depression. A central propellant tube in the body of the warhead contains a propellant charge; radial range spacers and radial firing tubes are disposed between the cover plates, the radial range spacers being disposed between successive firing tubes.

Means are provided to connect the inner ends of the firing tubes to the central propellant tube so that upon ignition of the propellant charge the slave missiles are ejected from the warhead. A parachute is disposed in the depression in one cover plate, and a proximity fuse is disposed in the depression in the other cover plate in the region of an end of the central propellant tube in the warhead.

As a result of its disc-shape construction, the warhead according to the invention offers the possibility of disposing a large number of warheads, one behind the other, in a loadcarrying missile, and of accomodating a large amount of effective explosive in the slave missiles with an adequate amount of propellant powder for ejecting the slave missiles from the warhead. The depressions in the cover plates of the warhead permit an advantageous accomodation of the parachute and of the proximity fuse, and as a result of the formation of the depression and the range spacers used, a great strength is achieved in the axial direction so that the warheads can rest one against the other and can withstand the great firing acceleration attendant upon the firing of the warhead from a barrel weapon.

Further details and advantages of the invention will become apparent from the following description of the accompanying drawing, in which.

Figure 1:
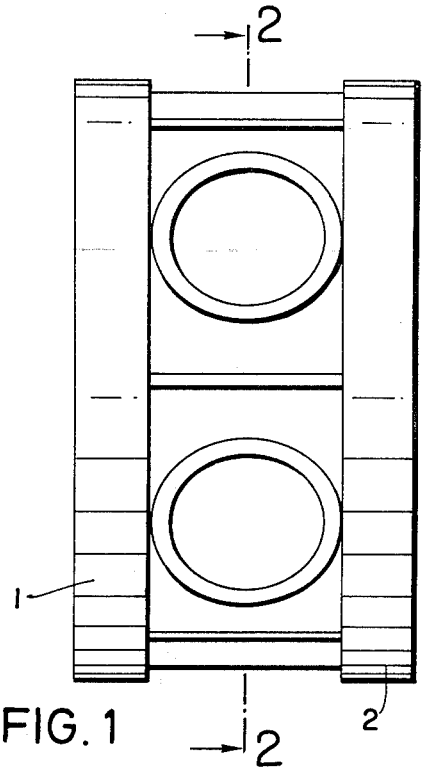
FIG. 1 is a view in elevation of a preferred embodiment of the warhead according to the invention.
Figure 3:
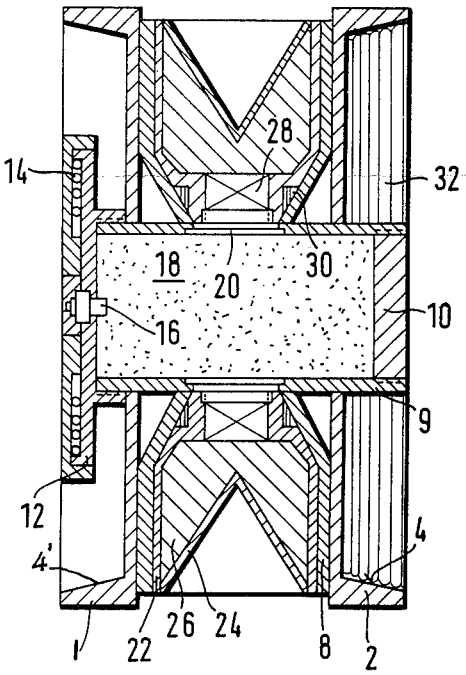
Fig. 3 is a view in longitudinal section through the warhead according to the invention, the section being taken along the line 3—3 in FIG. 2.
Figure 2:
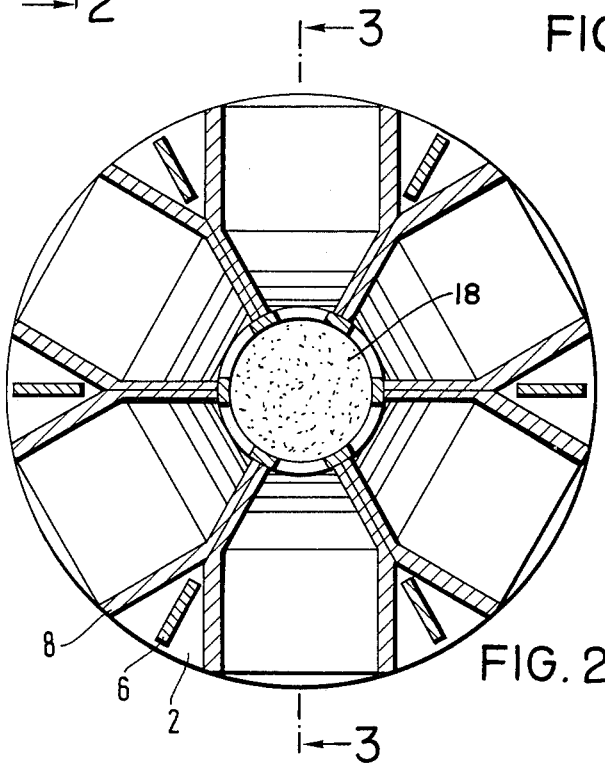
FIG. 2 is a view in transverse section through the warhead, the section being taken along the line 2—2 in FIG. 1.

The housing of the disc-shaped warhead includes an upper cover plate 2 and a lower cover plate 1, each cover plate being provided with an annular depression 4,4', respectively, radial range spacers 6 disposed between the cover plates 1 and 2, and radially disposed firing tubes 8, as well as a central axially disposed propellant tube 9. As shown in FIG. 2, the range spacers 6 are each disposed between the radially outer ends of successive firing tubes. The propellant tube 9 is closed at its upper end by a plug 10. Disposed around the upper end of tube 9 in the annular depression 4 is a folded or coiled parachute 32. The lower end of the tube 9 is provided with a housing structure containing a proximity fuse 14, not illustrated in detail, which through an ignition charge 16 ignites a propellant charge 18 in the propellant tube 9 when the warhead has reached the distance of, for example, 0.5–1.5 m from the ground or target.

The propellant gases act through openings 20 which establish connections between the propellant tube 9 and the firing tubes 8 disposed radially thereof. In this manner, the slave missiles, which are constructed in the form of hollow-charge missiles, are fired radially at targets situated within range of the warhead. Each of the hollow-charge missiles comprises a casing 22 and a spike-forming cover 24 for the explosive medium 26 contained in the firing tube. Disposed at the rear end of the casing 22 is a fuse 28 which ignites the explosive 26 in a manner known per se. In order to stabilize the hollow-charge missile, a wound or folded tear unit 30 is fitted to the rear end of each missile, such tear unit unfolding after leaving the firing tube 8.

The front region of the firing tube 8 is substantially round or square in shape and is disposed between the cover plates 2, as discussed above. The rear region of each of the firing tubes 8 is in the form of a frustum of a pyramid or of frustoconical shape, and becomes narrower in a radially inward direction (FIG. 2) so that all of the space between the cover plates 2 is utilized. The casings 22 of the hollow-charge missiles are adapted to the shape of the firing tubes 8, so that such casing 22 also has the maximum possible volume for the explosive charge.

A single propellant charge 18 for all of the slave missiles is provided in the propellant tube 9 and acts upon these through the openings 20, above discussed. In this manner, the slave missiles are fired uniformly radially and can develop the desired effect in the target. The construction of the warhead according to the invention, which is very massive and rigid as a whole, renders possible the passing on from one warhead stack in a low-carrying missile to the next of the axial acceleration forces which are developed during the firing of such stack from a barrel weapon, without stressing or deforming the warheads in an inadmissible manner, while at the same time making advantageous use of the space in the load-carrying missile. As a result, a large number of highly effective warheads can be carried into the target area by a single load-carrying missile, and can be ejected there in a known manner. When the fuses 28 are proximity fuses, the slave missiles are each ignited individually after reaching a predetermined distance from the ground or target. It is thus possible to combat a plurality of targets simultaneously and, because of the satisfactory hollow charge effect, even to combat heavy tanks.

Although the invention is illustrated and described with reference to one preferred embodiment thereof, it is to be expressly understood that it is in no way limited to the disclosure of such a preferred embodiment, but is capable of numerous modifications within the scope of the appended claims.

We claim:

1. In a warhead having a casing, a plurality of slave missiles containing explosive material disposed in firing tubes mounted in the casing and directed radially thereof, a parachute connected to the warhead and causing a directional, braked descent thereof in the target area, a proximity fuse on the warhead causing the ejection of the slave missiles from the warhead, the improvement wherein the warhead is of disc-shaped construction, the casing of the warhead having a cover plate at each end thereof, each cover plate having an outwardly open depression therein, a central propellant tube in the casing receiving a propellant charge, radial range spacers and radial firing tubes disposed between the cover plates and the radial range spacers, and means connecting the propellant tube to the radially inner ends of the slave missiles whereby the slave missiles are ejected from the warhead upon the firing of the propellant charge in the propellant by the proximity fuse.

2. A warhead as claimed in claim 1, wherein the firing tubes have a diameter adjacent their outer ends which is generally equal to the spacing of the cover plates, the firing tubes becoming narrower in a radially inner region of their length near the central tube, and wherein the slave missiles are hollow-charge missiles adapted to the shape of the firing tubes.

3. A warhead as claimed in claim 2, wherein at least some of the slave missiles have a stabilizing unit attached to their rear ends.

4. A warhead as claimed in claim 4, wherein the stabilizing unit comprises a wound member which becomes extended after its missile has left the firing tube.

5. A warhead as claimed in claim 1, wherein the parachute is disposed in the annular depression in one cover plate, and the proximity fuse is disposed in the annular depression in the other cover plate in the region of an end of the central propellant tube.

6. A warhead as claimed in claim 1, wherein the warhead is adapted to be stacked with a plurality of similar missiles in a load-carrying missile, the warheads being ejected one after the other from the load-carrying missile after the firing of the latter.

7. A warhead as claimed in claim 1, wherein each of the slave missiles has a proximity fuse.

* * * * *